United States Patent [19]

Curtis et al.

[11] Patent Number: 4,719,954

[45] Date of Patent: Jan. 19, 1988

[54] AWNING ASSEMBLY WITH TELESCOPING SUPPORT ARMS

[75] Inventors: Richard D. Curtis; Gayle G. Juracek; Jerry T. Scherer, all of Wichita, Kans.

[73] Assignee: The Coleman Company, Inc., Wichita, Kans.

[21] Appl. No.: 903,642

[22] Filed: Sep. 2, 1986

[51] Int. Cl.[4] ..... E04F 10/06

[52] U.S. Cl. ..... 160/67; 160/71; 135/89

[58] Field of Search ..... 160/67, 69, 71, 72, 160/73, 78, 79, 80, 81, 22; 135/88, 89

[56] References Cited

U.S. PATENT DOCUMENTS

| | | | |
|---|---|---|---|
| 2,967,535 | 1/1961 | Freeman | 135/89 |
| 3,004,591 | 10/1961 | King | 160/67 X |
| 3,025,866 | 3/1962 | Cockrum | 135/89 X |
| 3,918,510 | 11/1975 | Hayward | 160/22 X |
| 3,952,758 | 4/1976 | Addison et al. | 135/89 |
| 3,980,121 | 9/1976 | McKee | 135/89 X |
| 4,077,419 | 3/1978 | Lux | 135/89 |
| 4,117,876 | 10/1978 | Bennett | 160/67 |
| 4,160,458 | 7/1979 | Marcellus | 160/67 X |
| 4,253,689 | 3/1981 | McKee | 160/67 X |
| 4,530,389 | 7/1985 | Quinn et al. | 160/67 X |

*Primary Examiner*—Ramon S. Britts
*Assistant Examiner*—David M. Purol

[57] ABSTRACT

An awning assembly which is particularly suited for recreational vehicles includes a pair of telescoping support arm assemblies and a pair of folding rafter arm assemblies. A roller is rotatably supported by the support arm assemblies, and an awning is wound and unwound on the roller. Each of the telescoping support arm assemblies includes inner and outer telescoping arms and a cable which is connected to the arms and to the roller for extending the telescoping arms when the roller unwinds the awning. Each of the folding rafter arm assemblies includes a pair of pivotally connected rafter arms, a latch pin for locking the rafter arms in an extended position, and a latch release which enables the rafter arms to pivot when the awning is wound up.

24 Claims, 27 Drawing Figures

FIG. 4
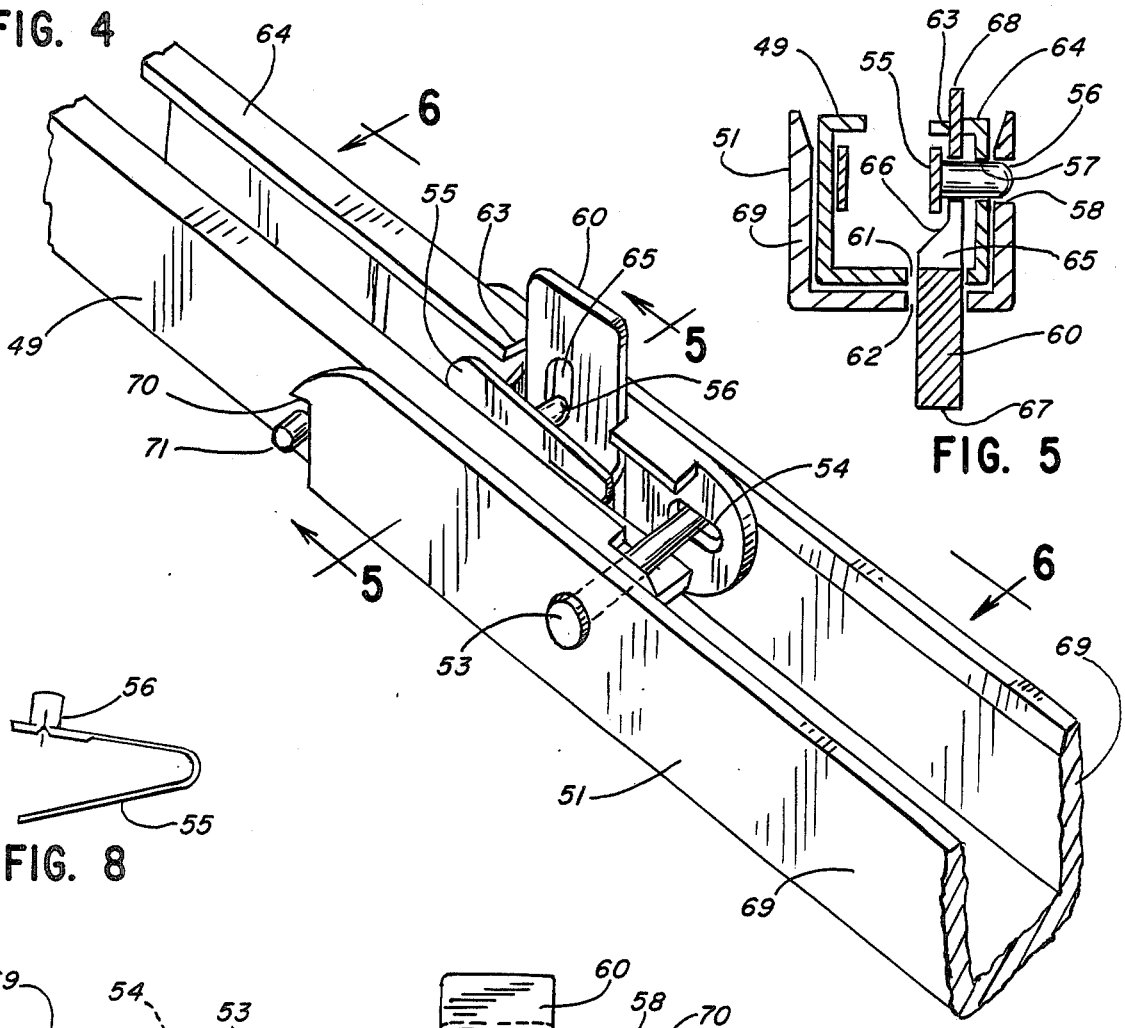
FIG. 5
FIG. 8
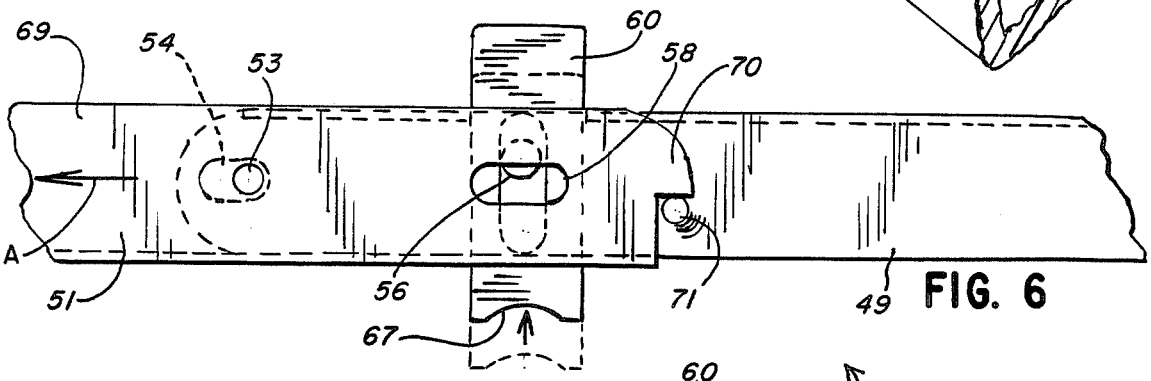
FIG. 6
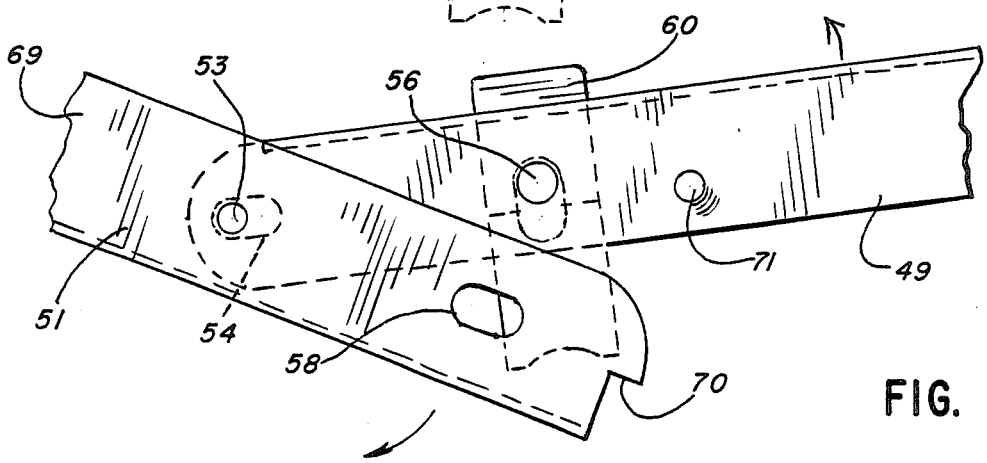
FIG. 7

FIG. 9
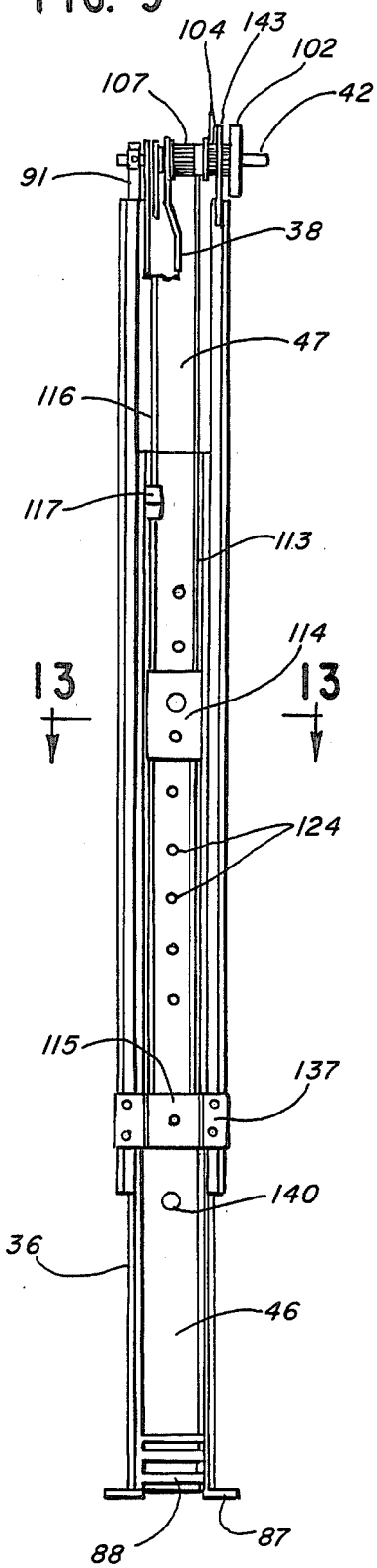
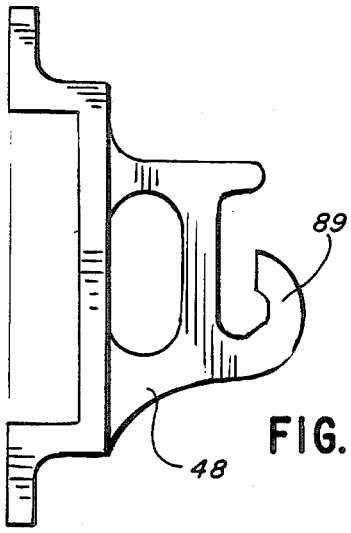
FIG. 10
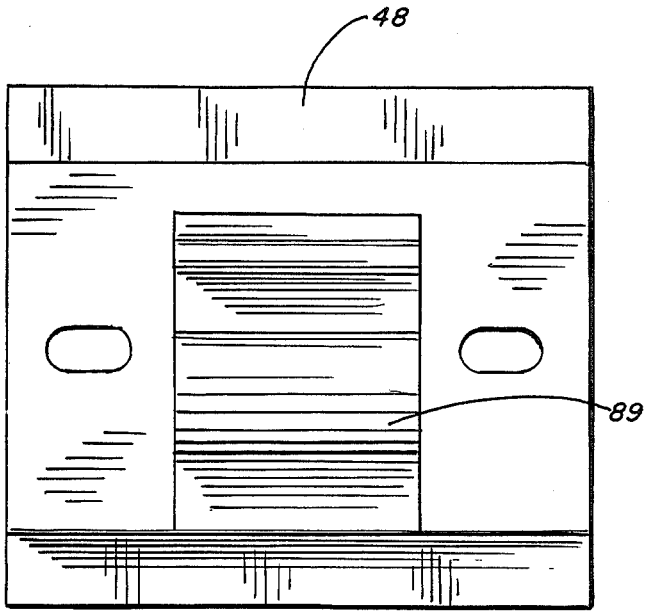
FIG. 11

FIG. 12
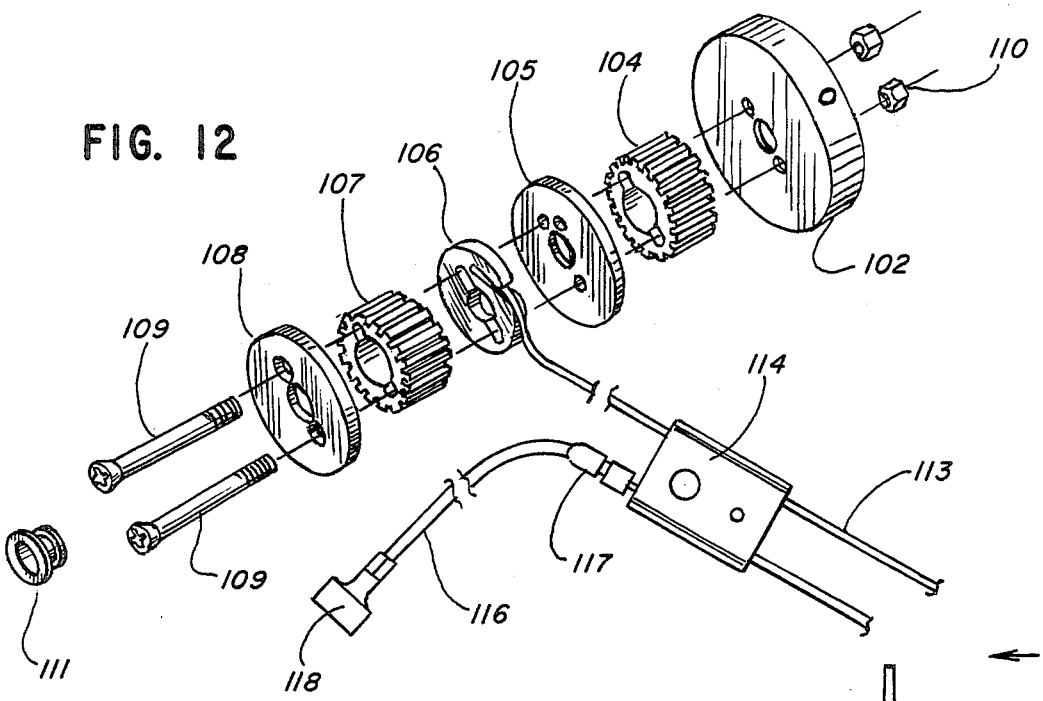
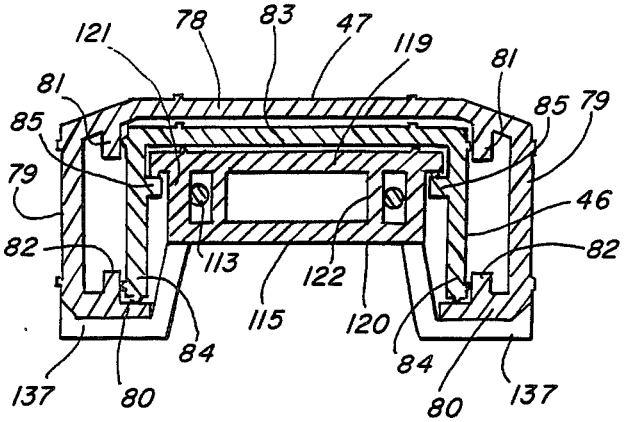
FIG. 13
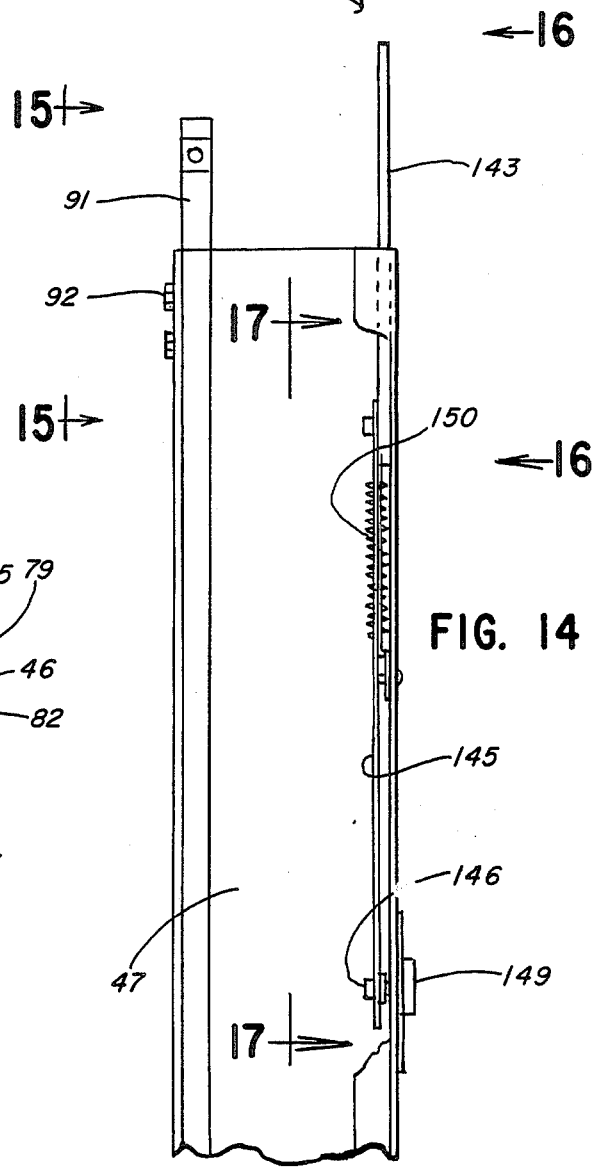
FIG. 14

FIG. 15
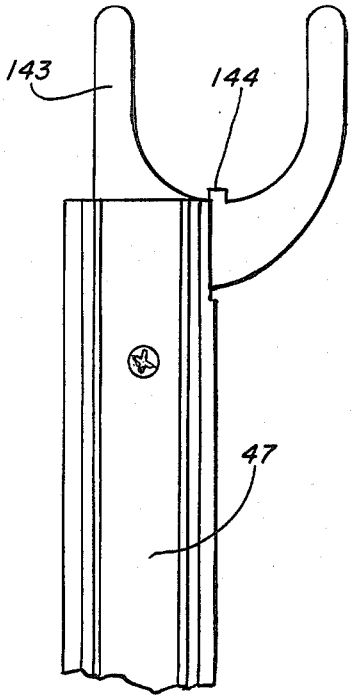
FIG. 16
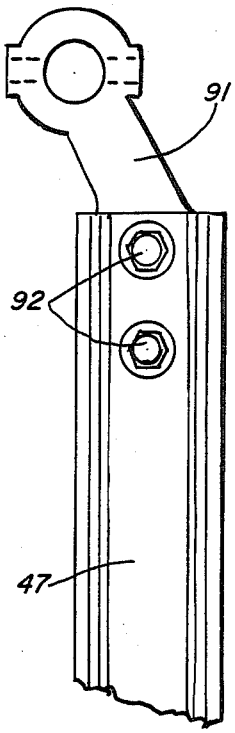
FIG. 17
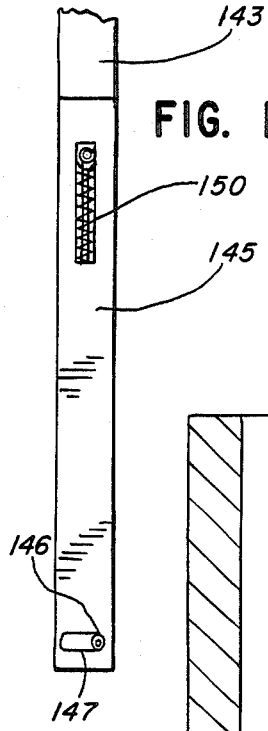
FIG. 18
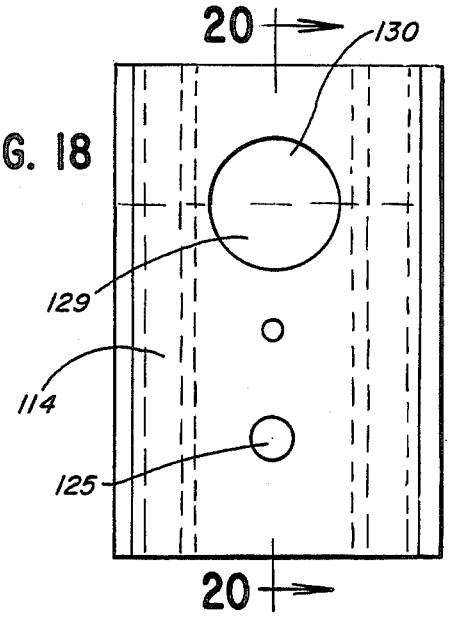
FIG. 19
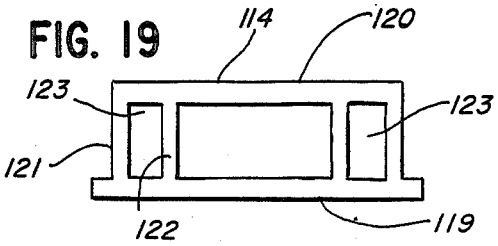
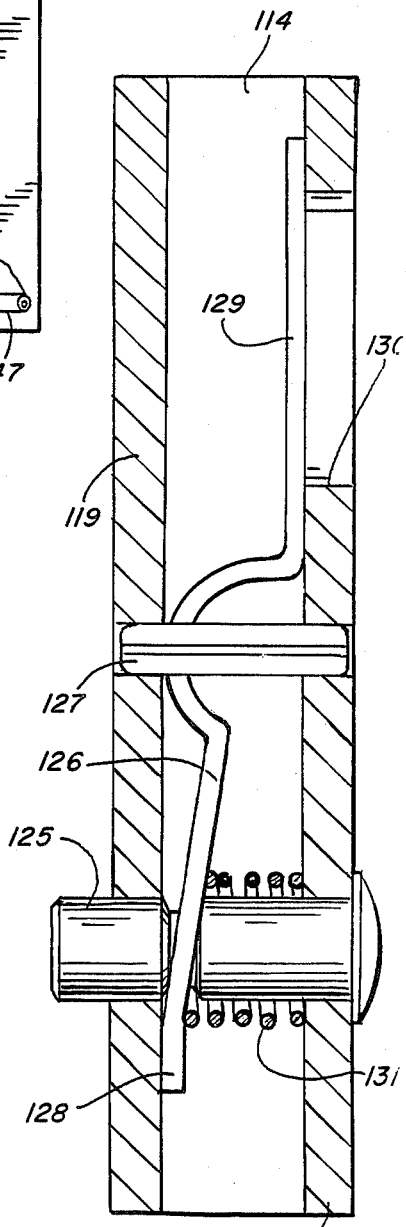
FIG. 20

FIG. 22
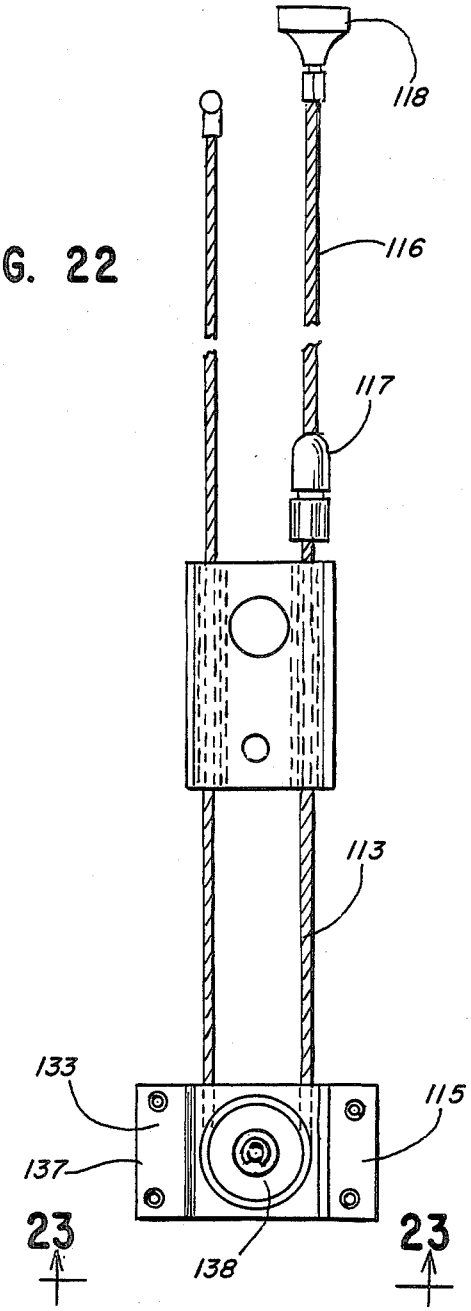
FIG. 21
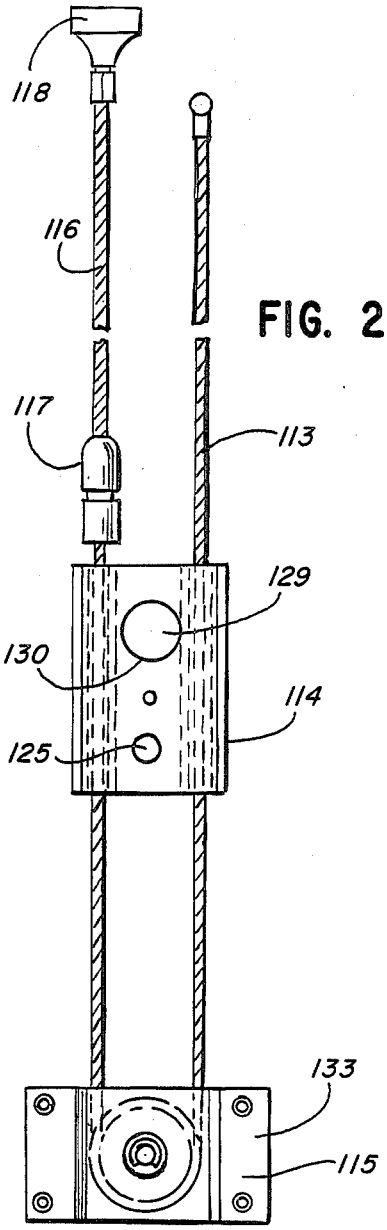
FIG. 23
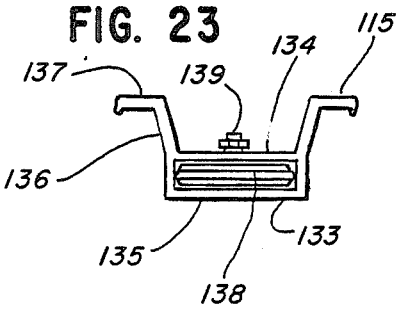
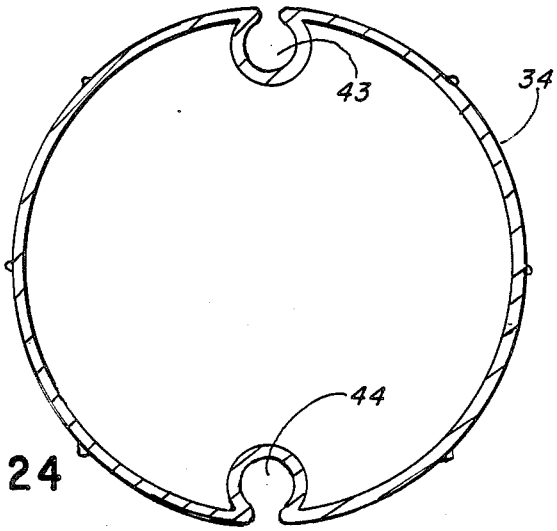
FIG. 24

FIG. 25
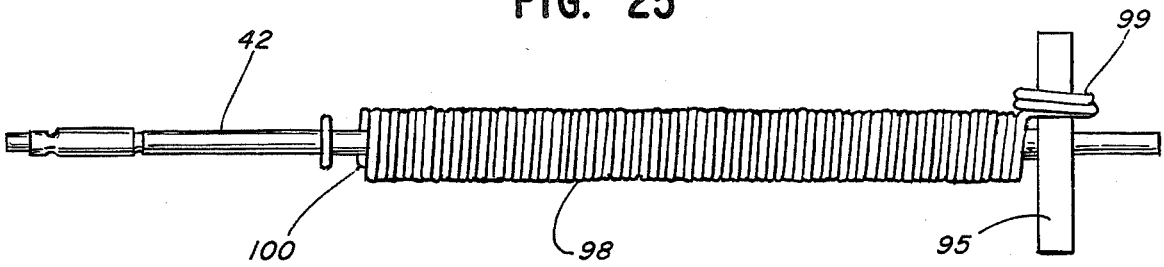
FIG. 26
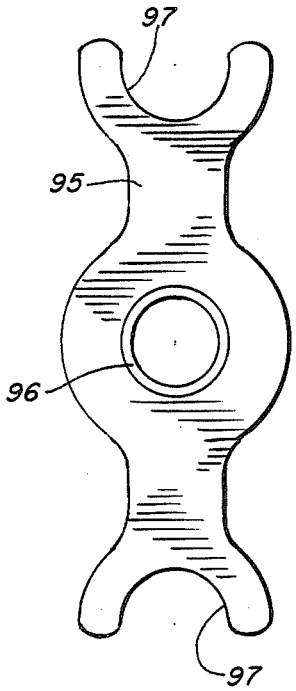
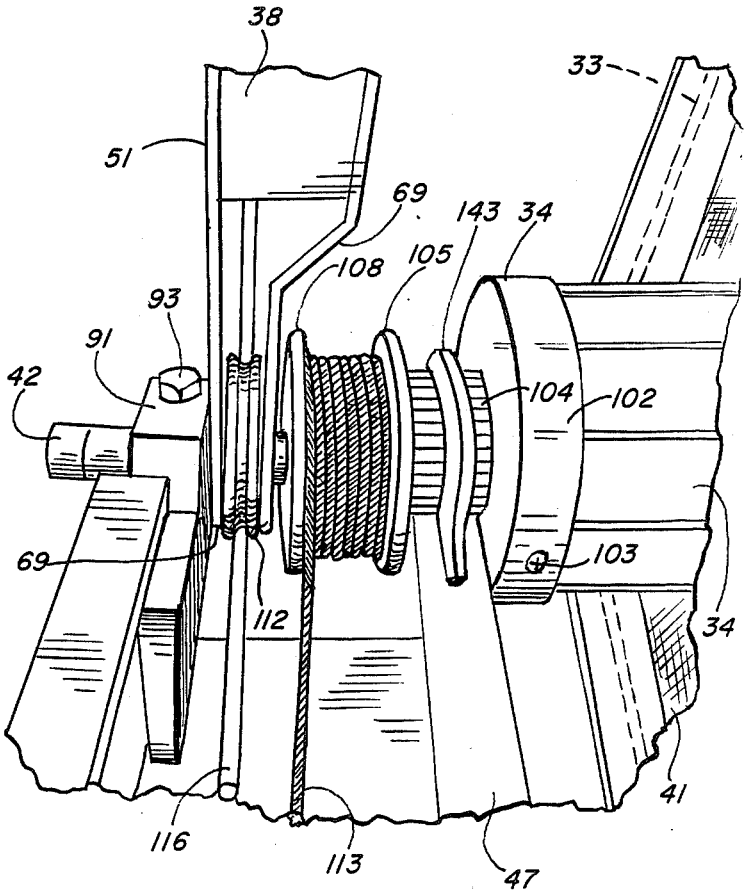
FIG. 27

AWNING ASSEMBLY WITH TELESCOPING SUPPORT ARMS

BACKGROUND

This invention relates to an awning assembly, and, more particulary, to an awning assembly which has automatically telescoping lower support arms and automatically locking upper support arms.

Owners of recreational vehicles such as travel trailers and motor homes often desire to set up an awning when the vehicle is parked for providing shade, protection from rain, etc. Awning assemblies are available which are mounted on the side of the vehicle. Such awning assemblies conventionally include a spring-biased roller on which the awning is wound, a pair of lower support arms which are pivotally mounted on the vehicle, and a pair of upper support arms which are also attached to the vehicle. The upper and lower support arms support the roller when the awning is extended. The lower support arms rotatably support the roller, and the awning is extended by pulling the roller away from the vehicle and pivoting the lower support arms so that the awning unwinds from the roller. The lower support arms are usually telescoping arms which are manually extended after the awning is unwound in order to raise the roller the desired distance from the ground.

The upper arms, called rafter arms, maintain the lower support arms in their outwardly pivoted positions. Rafter arms are conventionally of two types—telescoping arms and folding or broken arms. Telescoping rafter arms are usually manually extended or connected to the roller shaft or to the lower support arms after the awning is unwound. Folding or broken rafter arms include two pivotally connected arms which must be locked after the awning is unwound.

Accordingly, prior art awning assemblies generally require a number of manual steps in order to erect the awning. After the awning is unwound, the rafter arms must be connected or locked on each side, and the telescoping lower support arms on each side must be extended to the desired length. When the awning is wound up, these steps must be followed in the reverse order.

SUMMARY OF THE INVENTION

The invention provides an awning assembly in which the lower support arms telescope automatically to extend when the awning is unwound and telescope automatically to retract when the awning is wound up. As the awning is unwound, the actuating mechanism for extending the telescoping arms provides an initial delay so that the rafter arms do not bind and the upper ends of the telescoping arms do not raise the awning above its retracted position. The pivoting rafter arms automatically lock when the awning is unwound, and the lock is releasable to permit the awning to be wound up. After the lock is released, the awning can be wound up simply by pulling a strap which is attached to the roller. The awning can therefore be extended and retracted with a minimum of steps. Even though the lower support arms telescope automatically, the length of the telescoping arms can be adjusted as desired after the awning is unwound to set the height of one or both sides of the awning.

DESCRIPTION OF THE DRAWING

The invention will be explained in conjunction with an illustrative embodiment shown in the accompanying drawing, in which

FIG. 4 is an enlarged fragmentary perspective view of the rafter arms in the extended and locked position;

FIG. 5 is a sectional view taken along the line 5—5 of FIG. 4;

FIG. 6 is a fragmentary side elevational view taken along the line 6—6 of FIG. 4;

FIG. 7 is a view similar to FIG. 6 showing the rafter arms pivoting toward their folded position;

FIG. 8 is a top plan view of the latch spring for the rafter arms;

FIG. 9 is a view of the telescoping lower support arms as would be seen along, the line 9—9 of FIG. 2;

FIG. 10 is an enlarged side elevational view of the lower support bracket;

FIG. 11 is a front elevational view of the lower support bracket;

FIG. 12 is an exploded view, partially broken away, of one end of the awning roller;

FIG. 13 is a sectional view taken along the line 13—13 of FIG. 9;

FIG. 14 is an enlarged fragmentary view of the upper end of the right support arm;

FIG. 15 is a fragmentary side elevational view taken along the line 15—15 of FIG. 14;

FIG. 16 is a fragmentary side elevational view taken along the line 16—16 of FIG. 14;

FIG. 17 is a fragmentary side elevational view taken along the line 17—17 of FIG. 14;

FIG. 18 is an enlarged plan view of the shuttle for the telescoping lower support arms;

FIG. 19 is an end view of the shuttle of FIG. 18;

FIG. 20 is an enlarged sectional view taken along the line 20—20 of FIG. 18;

FIG. 21 is an enlarged fragmentary view of the actuating mechanism for the telescoping support arm of FIG. 9;

FIG. 22 is a view similar to FIG. 21 showing the actuating mechanism of the other telescoping support arm;

FIG. 23 is an end elevational view of the pulley assembly taken along the line 23—23 of FIG. 22;

FIG. 24 is an enlarged sectional view of the awning roller;

FIG. 25 is an elevational view of the roller shaft and spring assembly for the telescoping support arm of FIG. 9;

FIG. 26 is an elevational view of the roller insert for the spring assembly of FIG. 25; and FIG. 27 is an enlarged fragmentary perspective of the end of the roller assembly illustrated in FIG. 9.

DESCRIPTION OF SPECIFIC EMBODIMENT

Figure 1:
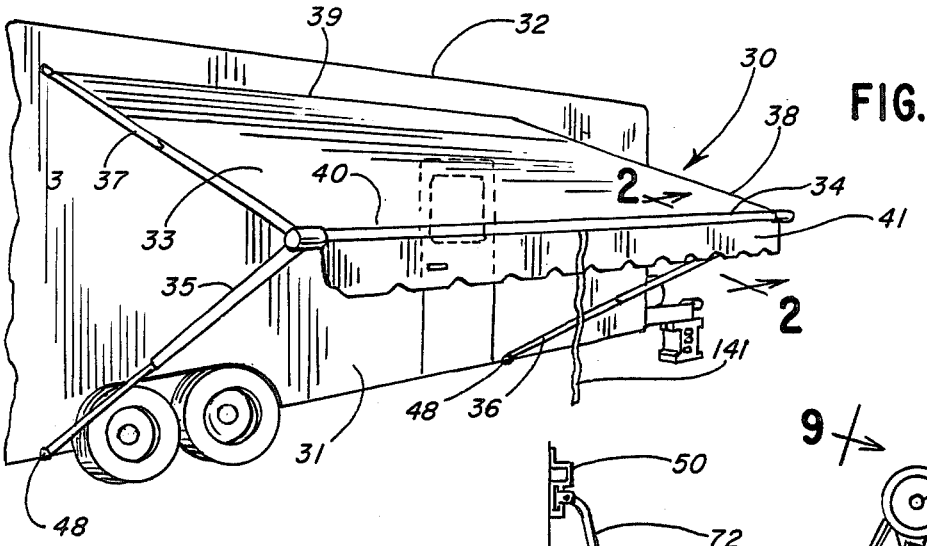
FIG. 1 is a fragmentary perspective view of a travel trailer equipped with an awning assembly constructed in accordance with the invention.

Referring to FIG. 1, the numeral 30 designates generally an awning assembly which is mounted on a side wall 31 of a travel trailer 32. The invention enjoys particular utility with respect to recreational vehicles such as travel trailers, but it will be understood that the awning assembly can be used with other support structures.

The awning assembly includes a vinyl-coated polyester awning 33, a roller 34 on which the awning can be wound, a pair of lower telescoping support arms 35 and 36, and a pair of upper pivoting rafter arms 37 and 38. The rear end of the awning is secured within a conventional rail which extends horizontally along the travel trailer. The forward end 40 of the awning is secured to the roller 34, and a valence 41 is also secured to the roller and hangs downwardly when the awning is unwound as shown in FIG. 1.

The roller 34 is an extruded hollow tube (FIG. 24), and, as will be explained more fully hereinafter, the roller is rotatably mounted on left and right axles or shafts 42 (FIGS. 2, 9, 25, and 27). The roller has a pair of grooves 43 and 44 (FIG. 24) for securing the awning and the valence, respectively. The ends of the awning and the valence are wrapped around cords, and each of the cords is inserted into one of the grooves to retain the awning or valence therein.

Figure 2:
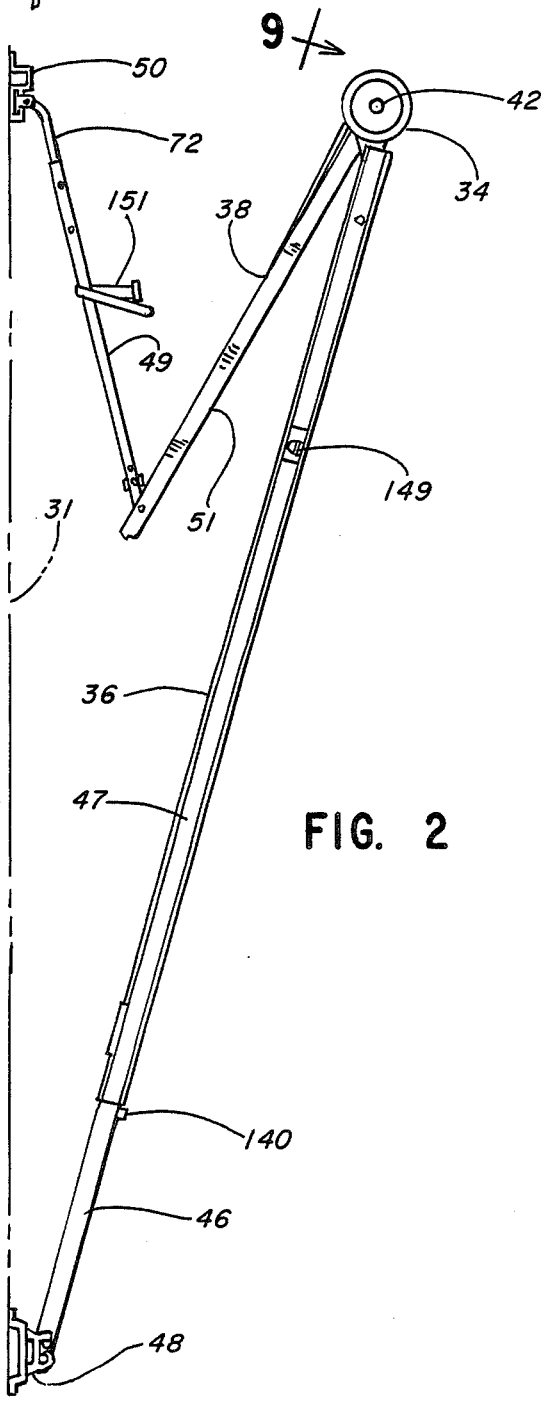
FIG. 2 is a sectional view of the telescoping lower support arms and the pivoting rafter arms in a partially open position as would be seen along the line 2—2 of FIG. 1.

Referring to FIG. 2, the right telescoping support arm 36 includes an inner or lower arm 46 and an outer or upper arm 47. The inner arm 46 is pivotally connected to the side wall 31 of the travel trailer by a lower mounting bracket 48 and the outer arm 47 supports the roller shaft 42. The rafter arm 38 includes an inner arm 49 which is pivotally connected to the side wall of the travel trailer by an upper mounting bracket 50, and an outer arm 51 which is pivotally connected to the inner rafter arm 49 and is rotatably connected to the roller shaft 42.

Referring to FIGS. 4–7, the rafter arms 49 and 51 are generally channel-shaped and are pivotally connected by a pin or rivet 53 which is mounted in openings in the side walls of the channel arm 51 and extends through elongated slots 54 in the side walls of the channel arm 49. The rafter arms 49 and 51 are releasably locked in the extended position illustrated in FIGS. 1 and 4 by a generally U-shaped latch spring 55 (see also FIG. 8) which is mounted within the channel-shaped arm 49 and which includes an outwardly extending latch pin 56. The inner and outer rafter arms 49 and 51 are provided with openings 57 and 58 (FIG. 5) for the latch pin. When the openings are aligned, the spring-biased latch pin extends through the openings and locks the rafter arms.

The latch pin can be released by a pushbutton 60 which extends downwardly through slots 61 and 62 (FIG. 5) in the inner and outer rafter arms and upwardly through a notch 63 in the top flange 64 of the inner rafter arm 49. The pushbutton has an elongated opening 65 through which the latch pin extends and a cam surface 66 which is engageable with one leg of the U-shaped latch spirng 55. The pushbutton has a lower actuating surface 67 and an upper actuating surface 68. When the lower actuating surface is pushed upwardly, the cam surface 66 forces one leg of the latch spring 55 to the left in FIG. 5 and withdraws the latch pin 56 from the opening 58 in the outer rafter arm 51.

Each of the side walls 69 of the channel-shaped outer rafter arm 51 extends beyond the pivot pin 53 and terminates in a shoulder 70. When the rafter arms are locked by the latch pin 56 as shown in FIG. 4, each of the shoulders is spaced slightly above a roll pin 71 which extends outwardly from the side wall of the inner rafter arm 49.

An elbow-shaped rafter bar 72 (FIG. 3) is telescopingly engaged with the inner end of the inner rafter arm 49. The rafter bar 72 is biased outwardly by a coil spring 73 inside of the rafter arm 49, and the end of the rafter bar 72 is pivotally connected to the support bracket 50 on the travel trailer. The rafter bar 72 is retained within the rafter arm 49 by a pin 74 which extends through the rafter arm 49 and through an elongated slot 75 in the rafter bar. The telescoping rafter bar permits the length of the rafter arm between the pivot 53 and the bracket 50 to vary as required during pivoting of the rafter arms to prevent binding of the rafter arms. If desired, the other rafter arm 51 could be made with variable length.

Each of the side walls 69 of the outer rafter arm 51 is provided with an opening 76 (FIG. 3) at the outer end of the rafter arm. The outer end of the roller shaft 42 extends through the opening 76 (FIG. 27), and the rafter arms 51 can pivot on the roller shaft.

Referring now to FIGS. 2, 9, and 13, the inner and outer arms 46 and 47 of the right telescoping support arm 36 are each generally channel-shaped and are slidably engaged. Each arm is advantageously extruded from aluminum.

The outer telescoping arm 47 includes a bottom wall 78 (FIG. 13), a pair of side walls 79, and a pair of laterally inwardly extending top flanges 80. A pair of rails 81 extend from the bottom wall 78, and a pair of rails 82 extend from the top flanges 80.

The inner telescoping arm 46 includes a bottom wall 83 and a pair of side walls 84. A pair of rails 85 extend laterally inwardly from the side walls. The inner arm 46 is confined within the outer arm 47, and the sliding surfaces of the inner arm are advantageously provided with ribs to reduce the area of contact between the two arms.

A mounting bracket 87 (FIG. 9) is attached to the bottom of the inner telescoping arm 46 and includes a plurality of horizontal rods 88. The telescoping support arm is attached to the travel trailer by inserting the bottom rod 88 into the hook portion 89 (FIG. 10) of the mounting bracket 48. The hook portion 89 pivotally supports the telescoping support arm.

A roller shaft support bracket 91 (FIGS. 9, 14, and 16) is attached to the upper end of the outer telescoping arm 47 by bolts 92. The outer end of the roller shaft 42 extends through an opening in the support bracket 91 and is secured against rotation by a bolt 93 (FIG. 27) which is inserted through the support bracket 91 and secured by a nut on the other side of the support bracket.

The hole in the support bracket 91 is larger than the diameter of the roller shaft 42 so that the shaft can pivot a few degrees about the axis of the bolt 93. This slight pivoting movement allows the awning to be set at a slant for rain runoff as will be described more fully hereinafter.

The inner end of the roller shaft 42 is supported by a roller insert 95 (FIGS. 25 and 26). A cylindrical bushing 96 is mounted in the center of the insert 95, and the insert has a pair of forked ends 97 which are shaped to extend around the grooves 43 and 44 (FIG. 24) in the roller 34. The insert is thereby connected to the roller for rotation therewith.

A coil spring 98 extends over the roller shaft 42. The inner end 99 of the spring is secured to the insert 95, and the outer end 100 extends through a hole in the roller shaft. The end 99 rotates with the roller, and the end 100 remains stationery. The coil spring is tensioned when the awning is unwound and rolls the awning up when the awning is retracted.

Referring to FIGS. 12 and 27, a roller cap 102 is secured to the end of the roller 34 by screws 103. A gear 104, a washer 105, a cable retainer disc 106, a second gear 107, and a washer 108 are secured to the roller cap by bolts 109 and nuts 110. The roller shaft 42 extends through each of the parts 104–108, and bushing 111 is mounted within the washer 108 for rotatably supporting the end of the roller on the shaft.

As can be seen in FIG. 27, the outer ends of the side walls 69 of the rafter arm 51 are positioned on the roller shaft 42 outwardly of the washer 108, and the support bracket 91 on the telescoping support arm 47 is connected to the shaft outside of the rafter arm 51. A pulley 112 is mounted on the shaft between the side walls 69 and the rafter arm 51.

The telescoping support arms 46 and 47 are extended by a cable 113 (FIGS. 9, 12, and 21) which is attached to the cable retainer disc 106 which is mounted on the roller. The cable extends through a shuttle 114 which is connected to the inner telescoping arm 46, around a pulley assembly 115 which is mounted on the bottom of the outer telescoping arm 47, and through the shuttle 114. An elastic shock cord 116 is attached to the cable by a connector 117. The elastic shock cord extends over the pulley 112 (FIG. 27) on the roller shaft and inside of the inner rafter arm 51. The end of the shock cord is attached to the pivot pin 53 of the rafter arms by a clip 118 on the end of the cord.

The shuttle 114 is advantageously extruded from aluminum and includes a bottom wall 119 (FIGS. 13 and 19), a top wall 120, and side walls 121. A pair of inner walls 122 form channels 123 through which the cable 113 extends. The bottom wall 119 extends laterally outwardly beyond the side walls 121 to permit the shuttle to be slidably retained within the inner telescoping arm 46 by the rails 85.

The inner telescoping arm 46 is provided with a plurality of longitudinally spaced openings 124 (FIG. 9), and the shuttle is locked with respect to the telescoping arm 46 by a locking pin 125 (FIGS. 18 and 20) which extends into one of the openings 124. The locking pin is retractable by a lever arm 126 which pivots about a pin 127. One end 128 of the lever arm engages a groove in the locking pin 125, and the other end 129 of the lever arm extends below a hole 130 in the top wall 120 of the shuttle 114. A spring 131 biases the end 128 of the lever arm downwardly.

The position of the shuttle 114 on the inner telescoping arm 46 can be adjusted by pushing the end 129 of the lever arm 126 to retract the locking pin 125 from one of the openings 124 in the telescoping arm 46. The shuttle can then be pushed along the telescoping arm 46 to the desired position, and when the lever arm 126 is released, the locking pin can extend into the appropriate opening 124 to lock the shuttle.

The pulley assembly 115 includes a pulley bracket 133 (FIGS. 21–23) which includes top and bottom walls 134 and 135, a pair of side walls 136, and a pair of outwardly extending top flanges 137. A pulley 138 is rotatably mounted between the walls 134 and 135 by a pin 139. Referring to FIGS. 9 and 13, the top flanges 137 are attached to the top flanges 80 of the outer telescoping arm 47 by screws, and the pulley 138 is aligned with the cable channels 123 in the shuttle 114.

Each of the upper support arms or rafter arms 37 and 38 have substantially the same structure, and each of the telescoping lower support arms 35 and 36 have substantially the same structure. Each end of the roller 34 is supported on a roller shaft 42, and each roller shaft is supported by a rafter arm and a telescoping lower support arm. The rafter arms 37 and 38 differ slightly at the ends which attach to the roller shaft 42. The ends of the rafter arms are bent to form left and right hand ports, the right hand port of the right rafter arm 38 being shown in FIG. 27.

When the awning is retracted or rolled up on the roller 34, the pivoted rafter arms 49 and 51 extend vertically upwardly along side each other, and the telescoping lower support arms 46 and 47 extend vertically upwardly from the support bracket 48. The channel-shaped lower support arms overlap and cover the folded rafter arms. The outer telescoping support arm 47 is pushed downwardly along the inner telescoping support arm 46 by the weight of the awning and engages a stop bolt 140 (FIGS. 2 and 9) near the bottom of the telescoping arm 46.

The awning is unwound by pulling a cloth strap 141 (FIG. 1) which is sewn to the awning canopy 33 and retained by groove 43 in roller 34. The strap winds up on the roller along with the awning and the valence, and a short end portion of the strap hangs from the retracted awning. Pulling the strap causes the roller to unwind and pivots the upper and lower support arms 46, 47, 49 and 51 outwardly away from the travel trailer as shown in FIG. 2. As the roller rotates on the roller shafts 42, the coil springs 98 are tensioned and the cables 113 are wound up on the gears 107 (FIGS. 9 and 12) between the washers 105 and 108. The gear 107 acts as a drum for the cable, and the gear teeth are non-functional. However, the gear 107 is identical to the gear 104, whose purpose will be explained hereinafter, and using the same part in both positions is economical.

As the cable 113 is wound up, it slides through the cable channels 123 in the shuttle 114 and around the pulley assembly 115 (FIGS. 9 and 21). The end of the cable which is attached to the elastic shock cord 116 is not restrained by the shock cord and moves downwardly toward the shuttle. The shock cord stretches to permit movement of the cable, and the purpose of the shock cord is to maintain tension on the end of the cable. The particular shock cord illustrated is a 3/16 inch exerciser cord with a black nylon jacket having 210% stretch which is available from Thomas Taylor & Sons of Hudson, Mass.

Even though the cable begins to wind up as soon as the awning roller begins to unwind, the telescoping arms 46 and 47 do not begin to extend immediately. A delay in the extension of the telescoping arms is important for two reasons. First, if the arms 46 and 47 attempt to extend immediately, they are prevented from extending by the folded rafter arms 49 and 51 which would lock up the mechanism. It is necessary to move the roller out from the wall, thus opening the pivoting arms 49 and 51. When these arms are open sufficiently, the telescoping arms 46 and 47 can be extended. Secondly, a delay in the extension of the telescoping arms is important so that the roller is not raised above its retracted position. At times the awning cannot be completely unwound, for example, when complete extension of the awning is obstructed by a tree, another vehicle, etc. If the telescoping arms begin to extend as soon as the roller began to unwind, the roller would be raised by the telescoping arms, and the awning would be inclined downwardly from the roller toward the vehicle if the awning could not be completely extended.

The delay in the extension of the telescoping arms is provided by the shuttle 114 and the connector 117 which connects the cable 113 to the shock cord 116. The cable travels freely through the shuttle until the connector 117 reaches the shuttle, and the outer telescoping arm 47 is maintained against the stop 140 on the inner telescoping arm 46 by the weight of the awning. However, when the connector 117 engages the shuttle 114, sliding movement of the cable relative to the shuttle is prevented. As the cable continues to be wound up by the roller, the length of the cable between the roller and the shuttle decreases, and the pulley assembly 115 which is attached to the outer telescoping arm 47 is pulled upwardly toward the shuttle 114, thereby extending the outer telescoping arm 47 from the inner telescoping arm 46. The extension of the telescoping arms automatically maintains the height of the roller at the desired position as the awning is unwound.

As the awning is unwound the pivoting rafter arms 49 and 51 move toward their extended position illustrated in FIG. 1 in which the rafter arms are aligned. As can be seen in FIGS. 4 and 5, the upper edges of the side walls 69 of the rafter arm 51 are beveled to provide camming surfaces, and the latch pin 56 is thereby cammed inwardly by the rafter arm 51 as the rafter arms approach their extended position. A short tug on the pull strap 141 just before the rafter arms reach their extended position will ensure that the pivoting rafter arms have sufficient momentum to snap the rafter arms into their extended position so that the latch pin 56 can extend through the opening 58 in the rafter arm 51 to lock the rafter arms.

It will be appreciated from the foregoing description that the awning can be unwound and locked in the extended position simply by pulling on the pull strap 141. The telescoping arms are extended automatically after an initial delay, and the pivoting rafter arms automatically pivot into their locked poistion. The spring biased rafter bar 72 (FIG. 3) which telescopes within the rafter arm 49 compensates for the changes in the distance between the support bracket 50 and the pivot pin 53 as the rafter arms pivot.

After the awning is extended, if it is desired to change the height of the roller 34, this can be accomplished simply by releasing the shuttle 114 from the inner telescoping arm 46 by withdrawing the locking pin 125 (FIG. 20), sliding the shuttle to the desired position, and then reinserting the locking pin 125 into the appropriate opening 124 in the telescoping arm 46. Referring to FIG. 9, when the telescoping arms 46 and 47 are extended, the connector 117 is in engagement with the shuttle 114. If the shuttle 114 is moved upwardly along the inner telescoping arm 46, the pulley assembly 115 and the outer telescoping arm 47 will be raised. If the shuttle 114 is moved downwardly along the inner telescoping arm 46, the pulley assembly 115 will be allowed to move downwardly under the weight of the awning. The lowermost position of the outer telescoping arm 47 is defined by the stop bolt 140.

If it is desired to move the awning to a rain position in which one side of the awning is lower than the other side, only one of the telescoping support arms 35 and 36 is adjusted. If it is desired to move the awning to a carport position, the telescoping support arms 35 and 36 are removed from the support brackets 48 and moved to a vertical position in which they extend between the roller and the ground. The height of the telescoping support arms can then be adjusted as desired by moving the shuttles 114.

When the awning is to be retracted, the pushbutton 60 (FIGS. 4–7) on each pair of rafter arms is pushed upwardly to cam the latch pin 56 out of the opening 58 in the outer rafter arm 51. The rafter arms are caused to pivot downwardly slightly by the tension exerted by the roller springs 98 and by gravity until the shoulder 70 on the rafter arm 51 engages the roll pin 71 on the rafter arm 49. Further pivoting movement of the rafter arms is thereby prevented. The shoulder 70 and the roll pin 71 thereby provide a secondary latch mechanism for retaining the awning in the extended position after the primary latch mechanism provided by the latch pin 56 is released. The cam 66 on the pushbutton 60 prevents the latch pin from reengaging the opening 58.

After the pushbutton 60 on each side of the awning is released, the awning can be retracted simply by exerting a sharp tug on the pull strap 141. As can be seen in FIG. 6, the tug on the pull strap will move the outer rafter arm 51 in the direction of the arrow A and move the shoulder 70 off of the roll pin 71 on the rafter arm 49. Longitudinal movement of the rafter arm 51 relative to the rafter arm 49 is permitted by the slot 54 in the rafter arm 49 through which the pivot pin 53 extends. When the shoulder 70 clears the roll pin 71, the tension provided by the roller springs 98 winds up the roller 34 and gravity causes the rafter arms to pivot downwardly as illustrated in FIG. 7. The rate at which the roller is rolled up by the roller springs 98 can be controlled by holding on to the pull strap 141.

As the roller winds up, each of the cables 113 for the telescoping support arms is unwound from the gear 107. As the cable is unwound, the outer telescoping arm 47 is permitted to slide downwardly along the inner telescoping arm 46. When the outer telescoping arm 47 engages the stop bolt 140, the elastic shock cord 116 continues to move the connector 117 on the cable 113 upwardly as the cable is unwound fromn the gear 107.

Figure 3:
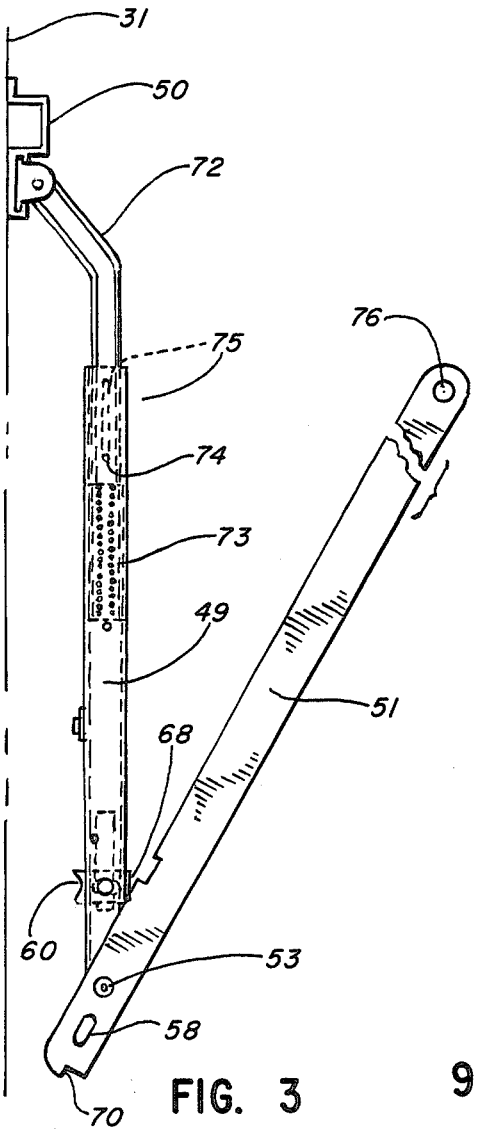
FIG. 3 is an enlarged fragmentary view of the rafter arms.

Referring to FIG. 3, as the rafter arms 49 and 51 pivot toward their folded or retracted position, the bottom wall of the channel-shaped rafter arm 51 engages the upper actuating surface 68 of the pushbutton 60 and moves the pushbutton back to its locking position illustrated in FIG. 5 so that the latch pin 56 can lock the rafter arms when the awning is next unwound.

When the awning is wound up or unwound to a partially extended position, it is desirable to lock the roller against rotation to prevent the awning from being unwound by wind. A locking fork 143 (FIGS. 9, 14, and 15) is slidably mounted at the upper end of the right outer telescoping arm 47 of support arm 36 and includes a gear tooth 144 (FIG. 15). When the awning is retracted, the sliding fork 143 can be raised to move the gear tooth 144 into engagement with one of the spaces in the gear 104 (see also FIGS. 12 and 27) to lock the roller against rotation.

The locking fork 143 is attached to a bar 145 (FIGS. 14 and 17), and the bar 145 can be reciprocated by a crank arm 146 which extends through a slot 147 in the bottom of the bar 145. The crank arm 146 is rotated by a knob 149 on the outside of the telescoping arm 47. A spring 150 biases the bar 145 and locking fork 143 upwardly toward the locking position.

A strap 151 (FIG. 2) can be wrapped around the rafter arms 49 and 51 and the telescoping arm 47 when the awning is retracted to further secure the awning assembly in the retracted position.

We have found that a sliding locking fork is not necessary on the left telescoping support arm 35. A fork is bolted to the top of the left telescoping arm to stabilize the arm.

If the awning is wound up when the awning is in the rain position in which one of the telescoping support arms 35 and 36 is shorter than the other, the roller will still be moved into the correct retracted position. Each of the telescoping support arms will retract as the awning is wound up until the outer telescoping arm 47 engages the stop bolt 140. The retracted length of the telescoping support arms 35 and 36 is therefore always the same regardless of the position of the shuttle 114 along the length of the inner telescoping arm 46.

Although the specific embodiment illustrated and described includes a wire cable 113 for extending the telescoping support arms, other elongated flexible members can be used, for example, ropes, cords, wires, etc.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. An awning assembly comprising:

an awning having an inner end and an outer end, the inner end adapted to be attached to a support structure, a roller having a pair of ends and means for attaching the outer end of the awning to the roller whereby the awning can be wound and unwound on the roller, a first telescoping support arm assembly having an upper end for rotatably supporting one end of the roller and a lower end adapted to be pivotally attached to the support structure and a second telescoping support arm assembly having an upper end for rotatably supporting the other end of the roller and a lower end adapted to be pivotally attached to the support structure, each of the telescoping support arm assemblies including an inner arm and on outer arm telescopingly engaged with the inner arm, actuating means connected to the telescoping support arm and the roller for extending the telescoping support arm when the roller unwinds the awning and for retracting the telescoping support arm when the roller winds up the awning, a first rafter arm assembly having an outer end for supporting one end of the roller and an inner end adapted to be attached to the support structure and a second rafter arm assembly having an outer end for supporting the other end of the roller and an inner end adapted to be attached to the support structure.

2. The awning assembly of claim 1 in which each said actuating means includes means for delaying extension of the associated telescoping support arm assembly until the roller unwinds the awning a predetermined amount.

3. The awning assembly of claim 1 in which each of said actuating means includes a drum connected to the roller for rotation therewith, a flexible elongate member attached to the drum whereby the flexible elongate member is wound on the drum when the roller unwinds the awning, and means for engaging the flexible elongate member with one of the inner and outer arms of the associated telescoping support arm assembly for extending the telescoping support arm assembly when the flexible elongate member is wound on the drum.

4. The awning assembly of claim 3 in which each of the means for engaging the flexible elongate member includes means for delaying the extension of the associated telescoping support arm assembly until the roller unwinds the awning a predetermined amount.

5. The awning assembly of claim 1 in which the inner arm of each of the telescoping arm assemblies is adapted to be attached to the support structure and the outer arm rotatably supports an end of the roller, each of the actuating means including:

a drum connected to the roller for rotation therewith, a flexible elongate member attached to the drum for winding thereon as the roller unwinds the awning, a pulley mounted on the outer arm of the associated telescoping arm assembly adjacent the lower end thereof, and means on the inner arm above the pulley for engaging the flexible elongate member, the flexible elongate member extending downwardly from said engaging means around the pulley and upwardly to said drum whereby the flexible elongate member pulls the pulley upwardly to extend the telescoping arm assembly as the flexible elongated member is wound on the drum.

6. The awning assembly of claim 1 in which each of the rafter arm assemblies includes an inner rafter arm adapted to be attached to the support structure and an outer rafter arm pivotally connected to the inner rafter arm, one of the inner and outer rafter arms being of variable length, the inner and outer rafter arms being movable between a folded position in which the arms extend from the pivot connection alongside each other and an extended position in which the arms extend from the pivot connection away from each other, a latch for releasably locking the inner and outer rafter arms in the extended position, and latch release means engageable with the latch for releasing the latch.

7. The awning assembly of claim 6 including secondary latch means on the inner and outer rafter arms for preventing pivoting movement of the inner and outer rafter arms from the extended position when the latch is released, and means for releasing the secondary latch means for permitting the inner and outer rafter arms to pivot.

8. The awning assembly of claim 6 in which the latch includes a lock pin which extends outwardly from one of the rafter arms and is engageable with an opening in the other rafter arm for locking the rafter arms in the extended position, the latch release means including a cam which is engageable with the lock pin for moving the pin from a locking position to an unlocked position.

9. The awning assembly of claim 8 in which the cam includes a first actuating surface which can be pushed to withdraw the locked pin from the opening in the other rafter arm and a second actuating surface which is engageable with the other rafter arm when the rafter arm is moved to the folded position whereby the cam is moved to permit the lock pin to move to the locking position.

10. The awning assembly of claim 7 in which the secondary latch means includes a pin which extends outwardly from one of the rafter arms and a shoulder on the other rafter arm which is engageable with the pin, the rafter arms being pivotally connected by a pivot pin which extends between the rafter arms, said means for releasing the secondary latch means including a slot in one of the rafter arms through which the pivot pin extends.

11. The awning assembly of claim 6 in which the secondary latch means includes a pin which extends outwardly from one of the rafter arms and a shoulder on the other rafter arm which is engageable with the pin, the rafter arms being pivotally connected by a pivot pin which extends between the rafter arms, said means for releasing the seconedary latch means including a slot in one of the rafter arms through which the pivot pin extends.

12. The awning assembly of claim 2 in which each of the rafter arm assemblies includes an inner rafter arm adapted to be attached to the support structure and an outer rafter arm pivotally connected to the inner rafter arm, the inner and outer rafter arms being movable between a folded position in which the arms extend from the pivot connection alongside each other and an extended position in which the arms extend from the pivot connection away from each other, a latch for releasably locking the inner and outer rafter arms in the extended position and latch release means engageable with the latch for releasing the latch.

13. The awning assembly of claim 12 including secondary latch means on the inner and outer rafter arms for preventing pivotal movement of the inner and outer rafter arms from the extended position when the latch is released, and means for releasing the secondary latch means for permitting the inner and outer rafter arms to pivot.

14. The awning assembly of claim 12 in which the latch includes a lock pin which extends outwardly from one of the rafter arms and is engageable with an opening in the other rafter arm for locking the rafter arms in the extended positoin, the latch release means including a cam which is engageable with the lock pin for moving the pin from a locking position to an unlocked position.

15. The awning assembly of claim 14 in which the cam includes a first actuating surface which can be pushed to withdraw the locked pin from the opening in the other rafter arm and a second actuating surface which is engageable with the other rafter arm when the rafter arm is moved to the folded position whereby the cam is moved to permit the lock pin to move to the locking position.

16. The awning assembly of claim 13 in which the secondary latch means includes a pin which extends outwardly from one of the rafter arms, a shoulder on the rafter arm which is engageable with the pin, the rafter arms are pivotally connected by a pivot pin which extends between the rafter arms and said means for releasing the secondary latch means including a slot in one of the rafter arms through which the pivot pin extends.

17. The awning assembly of claim 1 in which each of the rafter arm assemblies comprises inner and outer pivotally connected rafter arms of substantially equal length.

18. The awning assembly of claim 17 in which the inner and outer rafter arms of each of the rafter arm assemblies are movable between a folded position in which the arms extend from the pivot connection along side each other and an extended position in which the arms extend from the pivot connection away from each other, a latch for releasably locking the inner and outer rafter arms in the extended position, and latch release means engageable with the latch for releasing the latch.

19. An awning assembly comprising:

(a) an awning having an inner end and an outer end, the inner end adapted to be attached to a support structure;

(b) a roller having a pair of ends and means for attaching the outer end of the awning to the roller whereby the awning can be wound and unwound on the roller;

(c) a first telescoping support arm assembly having an upper end for rotatably supporting one end of the roller and a lower end adapted to be pivotally attached to the support structure and a second telescoping support arm assembly having an upper end for rotatably supporting the other end of the roller and a lower end adapted to be pivotally attached to the support structure, each of the telescoping support arm assemblies including an inner arm and an outer arm telescopingly engaged with the inner arm, actuating means connected to the telescoping support arm and the roller for extending the telescoping support arm when the roller unwinds the awning and for retracting the telescoping support arm when the roller winds up the awning, the inner arm of each of the telescoping arm assemblies being adapted to be attached to the support structure and the outer arm rotatably supporting an end of the roller, each of the actuating means including:

(i) a drum connected to the roller for rotation therewith, (ii) a flexible elongate member attached to the drum for winding thereon as the roller unwinds the awning, (iii) a pulley mounted on the outer arm of the associated telescoping arm assembly adjacent the lower end thereof, and (iv) means on the inner arm above the pulley for engaging the flexible elongate member, the flexible elongate member extending downwardly from said engaging means around the pulley and upwardly to said drum whereby the flexible elongate member pulls the pulley upwardly to extend the telescoping arm assembly as the flexible elongated member is wound on the drum, said means for engaging the flexible elongate member including a stop member mounted on the inner arm, the flexible elongate member extending slidably through the stop member and including an abutment which is engageable with the stop member for preventing relative movement between the flexible elongate member and the stop member;

(d) a first rafter arm assembly having an outer end for supporting one end of the roller and an inner end adapted to be attached to the support structure and a second rafter arm assembly having an outer end for supporting the other end of the roller and an inner end adapted to be attached to the support structure.

20. The awning assembly of claim 19 in which the abutment on the flexible elongate member is spaced above the stop member when the awning is fully wound on the roller, whereby the awning may unwind a predetermined amount before the abutment engages the stop member and the telescoping arm assembly begins to extend.

21. The awning assembly of claim 20 including an elastic cord attached to the end of the flexible elongate member opposite the drum.

22. The awning assembly of claim 19 in which the stop member is adjustably mounted on the inner telescoping arm whereby the extended length of the telescoping arm assembly can be adjusted.

23. The awning assembly of claim 22 in which the inner telescoping arm includes a pair of side walls and an inwardly extending rail on each of the side walls, the stop member comprising a shuttle which is slidably retained on the inner telescoping arm by the rails and means for connecting the shuttle to the inner telescoping arm at selected locations along the length of the inner telescoping arm.

24. The awning assembly of claim 23 in which the shuttle has a passage through which the flexible elongate member extends, the abutment on the flexible elongate member being engageable with the shuttle.

* * * * *